US010900389B2

(12) United States Patent
Pfeiffer et al.

(10) Patent No.: US 10,900,389 B2
(45) Date of Patent: Jan. 26, 2021

(54) INTERNAL COMBUSTION ENGINE WITH A HYDRAULICALLY VARIABLE GAS EXCHANGE VALVE TRAIN

(71) Applicant: Schaeffler Technologies AG & Co. KG, Herzogenaurach (DE)

(72) Inventors: Steffen Pfeiffer, Nuremberg (DE); Philipp Galster, Kirchehrenbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/326,944

(22) PCT Filed: Sep. 28, 2017

(86) PCT No.: PCT/DE2017/100828

§ 371 (c)(1),
(2) Date: Feb. 21, 2019

(87) PCT Pub. No.: WO2018/059627

PCT Pub. Date: Apr. 5, 2018

(65) Prior Publication Data

US 2019/0211718 A1 Jul. 11, 2019

(30) Foreign Application Priority Data

Sep. 29, 2016 (DE) ..... 10 2016 218 918

(51) Int. Cl.

| | |
|---|---|
| ***F01L 9/02*** | (2006.01) |
| ***F01L 3/06*** | (2006.01) |
| *F01L 1/344* | (2006.01) |

(52) U.S. Cl.
CPC ..... *F01L 9/025* (2013.01); *F01L 3/06* (2013.01); *F01L 9/02* (2013.01); *F01L 9/023* (2013.01); *F01L 2001/34446* (2013.01)

(58) Field of Classification Search
CPC ... F01L 9/025; F01L 9/02; F01L 9/023; F01L 9/021; F01L 3/06; F01L 3/00; F01L 2001/34446; F02F 1/24; F01M 13/04
(Continued)

(56) References Cited

U.S. PATENT DOCUMENTS 4,218,995 A * 8/1980 Aoyama ..... F01L 1/245 123/90.55
4,278,233 A 7/1981 Hansjuergen et al.
(Continued)

FOREIGN PATENT DOCUMENTS

CN 102713171 A 10/2012
CN 104481625 A 4/2015
(Continued)

*Primary Examiner* — Devon C Kramer
*Assistant Examiner* — Kelsey L Stanek
(74) *Attorney, Agent, or Firm* — Matthew Evans

(57) ABSTRACT

A hydraulically variable gas exchange valve train for an internal combustion engine is proposed that includes a hydraulic housing with a pressure chamber, a pressure relief chamber, and a vent duct. The vent duct is connected hydraulically on a housing inner side via a restriction to the pressure relief chamber, and opens on the housing outer side below the pressure relief chamber with regard to a direction of gravity. The vent duct opens into a hydraulic reservoir, wherein the vent duct opening lies below a normal level of the hydraulic reservoir with regard to the direction of gravity.

20 Claims, 3 Drawing Sheets

(58) Field of Classification Search
USPC ..... 123/90.57
See application file for complete search history.

(56) References Cited

U.S. PATENT DOCUMENTS

| | | | | | |
|---|---|---|---|---|---|
| 5,195,474 | A * | 3/1993 | Urata | F01L 9/025 | 123/196 M |
| 5,680,841 | A * | 10/1997 | Hu | F01L 1/181 | 123/321 |
| 2002/0179029 | A1 | 12/2002 | Watson et al. | | |
| 2011/0277712 | A1* | 11/2011 | Haas | F01L 9/025 | 123/90.12 |
| 2012/0145100 | A1* | 6/2012 | Meinig | F01L 1/46 | 123/90.15 |
| 2014/0190431 | A1* | 7/2014 | McCarthy, Jr. | F01L 1/18 | 123/90.16 |
| 2015/0369093 | A1* | 12/2015 | Leiber | F16K 31/047 | 137/12 |

FOREIGN PATENT DOCUMENTS

| | | | | |
|---|---|---|---|---|
| CN | 204402605 | U | 6/2015 | |
| CN | 105697086 | A | 6/2016 | |
| CN | 105765181 | A | 7/2016 | |
| CN | 205477806 | U | 8/2016 | |
| CN | 205578058 | U | 9/2016 | |
| DE | 102010018209 | A1 | 10/2011 | |
| DE | 102013213695 | A1 * | 1/2015 | F01M 13/04 |
| DE | 102013213695 | A1 | 1/2015 | |
| EP | 2060754 | A2 | 5/2009 | |
| RU | 2151305 | C1 | 6/2000 | |

* cited by examiner

INTERNAL COMBUSTION ENGINE WITH A HYDRAULICALLY VARIABLE GAS EXCHANGE VALVE TRAIN

CROSS-REFERENCE TO RELATED APPLICATIONS

This application is the U.S. National Phase of PCT Application No. PCT/DE2017/100828 filed Sep. 28, 2017 which claims priority to DE 102016218918.2 filed on Sep. 29, 2016, the entire disclosures of which are incorporated by reference herein.

TECHNICAL FIELD

This disclosure relates to an internal combustion engine having a hydraulically variable gas exchange valve train.

BACKGROUND

DE 10 2013 213 695 A1 shows an internal combustion engine having a fully variable hydraulic valve timing system. This is formed by a constructional unit which is mounted on the cylinder head of the internal combustion engine and the hydraulic chambers of which vent air downward into the cylinder head—in the direction of gravity.

The venting of the hydraulic system during operation brings about the discharge of the air bubbles carried along by the hydraulic fluid into the environment of the hydraulic housing and thus prevents an excessive quantity of air entering the pressure chamber and there compromising to an impermissible extent the rigidity of the hydraulic fluid required for hydraulic actuation of the gas exchange valves. On the other hand, venting promotes leakage of the hydraulic fluid from the hydraulic housing when the internal combustion engine is switched off. This is because the cooling hydraulic fluid, which shrinks in volume during this process, produces a vacuum in the hydraulic chambers, and this is compensated by the induction of additional air via the vent duct. During this pressure compensation, gravity ensures that the hydraulic chambers empty into the environment owing to leakage through the guide clearance between the slave piston and the hydraulic housing. Thus, when the internal combustion engine is stopped for a prolonged period, there is an increased risk that the hydraulic chambers will empty completely and the air in the pressure chamber will compromise the pressure buildup in the pressure chamber to such an extent, owing to the high compressibility, that the opening of the gas exchange valve required for the starting of the internal combustion engine will be prevented.

EP 2 060 754 A2 proposes a hydraulic unit having an additional low-pressure chamber, which communicates for the purpose of venting with the interior of the cylinder head via a housing opening in a geodetically high position and with the pressure relief chamber via a restriction in a geodetically low position. The low-pressure chamber forms an extended hydraulic reservoir which supplies the pressure chamber with sufficient air-free hydraulic fluid during the starting of the internal combustion engine. However, venting in a manner different from that in the preamble, i.e. counter to the direction of gravity and opening on the upper side of the hydraulic housing, requires a cylinder head cover which seals off the cylinder head with the hydraulic housing with respect to the environment, and thus an additional component.

SUMMARY

The problem addressed by the present disclosure is to develop an internal combustion engine of the type stated at the outset in such a way that the hydraulic leakage from the hydraulic housing is reduced to an extent such that the hydraulic fluid in the pressure chamber does not fall below a level critical for the starting process of the internal combustion engine, even after said engine has been stopped for a prolonged period.

The solution to this problem is obtained from the features described herein. Accordingly, the vent duct should open into a hydraulic reservoir, wherein the duct opening is below the normal level of the hydraulic reservoir in relation to the direction of gravity. The term "normal level" should be taken to mean the filling level which is established in the hydraulic reservoir in the steady state condition shortly after the internal combustion engine is switched off, wherein the internal combustion engine is not or at least not significantly sloping relative to its installation position. The duct opening "dipping" into the hydraulic fluid prevents air from being sucked back into the pressure relief chamber via the vent duct when the internal combustion engine is stopped and the hydraulic medium volume shrinks owing to cooling. This state extends over a sufficiently long period of time and at least until the level of the hydraulic reservoir has possibly fallen below the duct opening owing to the cooling-induced shrinkage in the volume of the hydraulic fluid from the hydraulic housing.

The hydraulic reservoir open toward the environment of the hydraulic housing can be formed either on the hydraulic housing itself or by a local hollow or trough shape of a component or section of the cylinder head or of the engine block of the internal combustion engine.

Advantageous developments and embodiments of this disclosure are described herein. Accordingly, the duct opening should be as low as possible in relation to the direction of gravity when the gas exchange valve is closed and, more specifically, should be below the boundary of the pressure chamber defined by the slave piston. The geodetic difference in height between the slave piston (retracted into the hydraulic housing) and the duct opening has a direct effect on the vacuum which forms relative to the environment of the hydraulic housing when the internal combustion engine is switched off and the hydraulic fluid shrinks and counteracts the gravity-induced leakage of the hydraulic fluid from the hydraulic housing.

For the reasons mentioned above, it is particularly advantageous if the duct opening is always below the level of the hydraulic reservoir in relation to the direction of gravity, i.e. geodetically. This state assumes that the hydraulic reservoir can be embodied with a sufficient volume in respect of the temperature- and leakage-induced decrease in the hydraulic volume in the hydraulic housing.

On the other hand, it is more probable that the volume of the hydraulic reservoir will be restricted structurally to such an extent that falling of the reservoir level below the duct opening and consequently sucking back of air are unavoidable. Nevertheless, the stop-page time of the internal combustion engine until the critical filling level in the pressure chamber is reached can be significantly extended by virtue of the fact that, at least locally, the vent duct has a cross section dimensioned in such a way that air bubbles can rise therein without pushing the overlying hydraulic or oil column in front of them and displacing it into the pressure relief chamber. On the contrary, the cross section is dimensioned in such a way that the air sucked back rises in the standing oil column, with the result that the remainder of the oil column as it were closes the duct opening again and maintains the leakage-inhibiting vacuum in the hydraulic housing. Tests in this regard by the applicant have shown that the vent duct must have a tube inside diameter of at least 6 mm in the case of an oil with the viscosity index 0W20 and in the case of a circular first tube section. Particularly good and robust results have been achieved with a tube inside diameter of about 8 mm. The circular shape of the vent duct can have ad-vantages in terms of manufacture. However, other cross-sectional shapes are possible as long as the air can rise without displacing the overlying oil column.

Furthermore, the duct opening can be formed by a circular second tube section, which adjoins with the first tube section with a (abrupt or gradual) reduction in the tube outside diameter from the first tube section to the second tube section. This design embodiment of the vent duct with the tube sections of stepped diameter may be required if the surface area of the hydraulic reservoir is too small to accommodate the relatively large diameter of the first tube section.

It is expedient if the vent duct is formed by a vent tube secured in, and preferably screwed into, the hydraulic housing, wherein the first and, where applicable, the second tube section are parts of the vent tube.

BRIEF DESCRIPTION OF THE DRAWINGS

Further features of this disclosure will be found in the following description and in the drawings, in which three illustrative embodiments of the disclosure are illustrated schematically. Unless stated otherwise, identical or functionally identical features or components are provided with identical reference signs here. In the drawings.

DETAILED DESCRIPTION

Figure 1A:
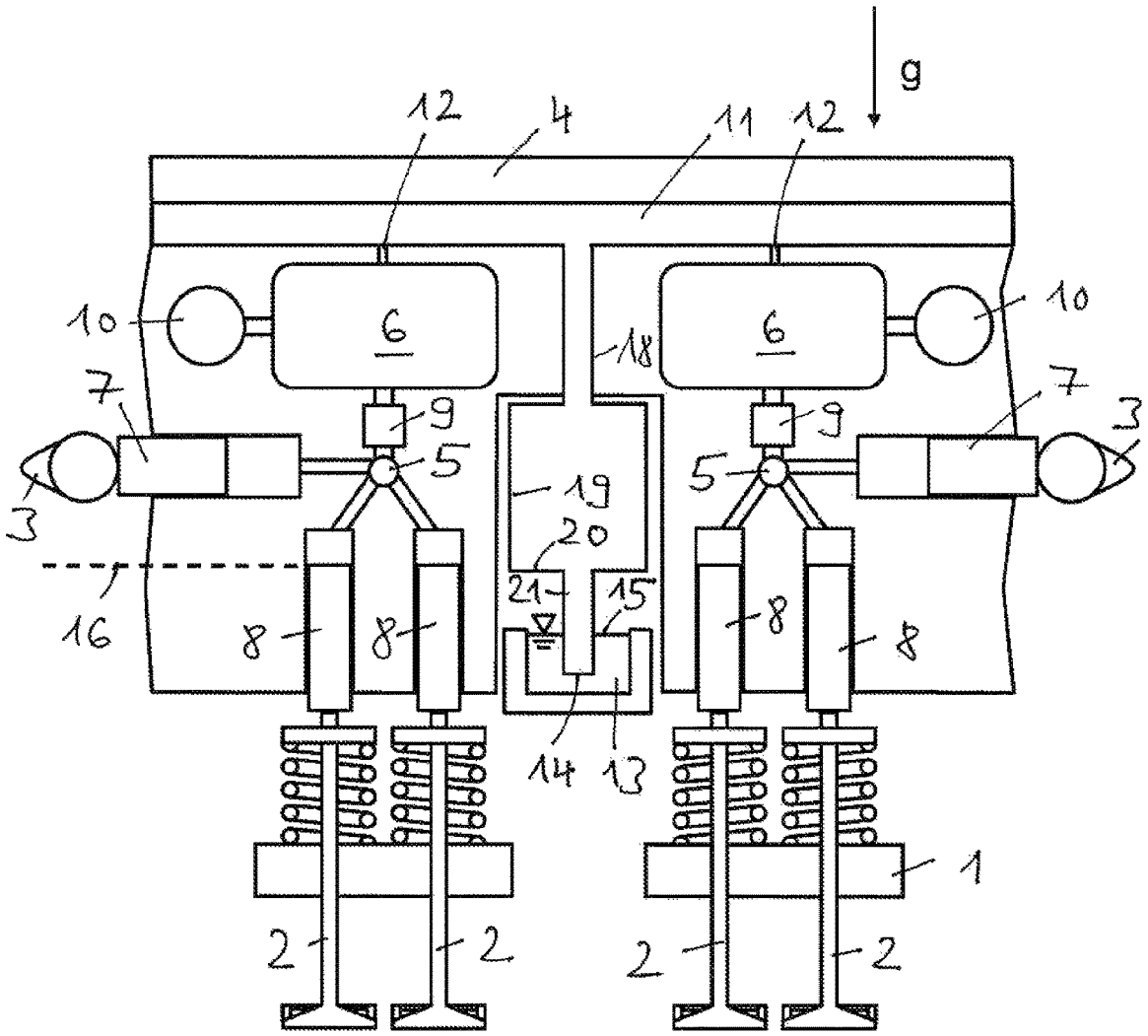
FIG. 1*a* shows the first illustrative embodiment with a vent duct of stepped diameter.

FIG. 1*a* shows schematically the section of the internal combustion engine which is essential to the understanding of this disclosure, having a hydraulically variable gas exchange valve train. It illustrates a cylinder head 1 having two gas exchange valves 2 of the same type per cylinder and associated cams 3 of a camshaft, the valves being subject to a spring force in the closing direction. The variability of the gas exchange valve train is produced in a known manner by means of a hydraulic unit arranged between the cams 3 and the gas exchange valves 2. This unit comprises a hydraulic housing 4, which is secured in the cylinder head 1 and in which one pressure chamber 5 and one pressure relief chamber 6 are formed and one master piston 7 is guided for each cylinder, said piston being driven on the housing outer side by the cam 3 and defining the pressure chamber 5 on the housing inner side. Two slave pistons 8 per cylinder are furthermore guided in the hydraulic housing 4, said pistons driving the gas exchange valves 2 on the housing outer side and defining the common pressure chamber 5 on the housing inner side. An electromagnetic hydraulic valve 9, in the present case a normally open 2/2-way valve, interrupts the hydraulic connection between the pressure relief chamber 6 and the pressure chamber 5 in the closed state. In the open state of the hydraulic valve 9, some of the hydraulic fluid displaced by the master piston 7 can flow off into the pressure relief chamber 6 without participating in the actuation of the slave piston 8 and of the associated gas exchange valve 2. A piston-type pressure accumulator 10 for receiving the displaced hydraulic fluid is connected to each pressure relief chamber 6. The pressure relief chambers 6 are connected via a hydraulic connection (not shown) on the hydraulic housing 4 to the hydraulic circuit, i.e. the oil circuit of the internal combustion engine.

The operation of the hydraulic gas exchange valve train, which is known per se, can be summarized in that the pressure chamber 5 between the master piston 7 and the slave piston 8 acts as a hydraulic linkage. Here, the hydraulic fluid, which is displaced by the master piston 7 proportionally to the lift of the cam 3—neglecting leaks—is divided in accordance with the opening time and the opening duration of the hydraulic valve 9 into a first partial volume, which acts on the slave piston 8, and a second partial volume, which flows off into the pressure relief chamber 6, including the piston-type pressure accumulator 10. This enables fully variable setting of the stroke transmission of the master piston 7 to the slave piston 8 and consequently not only of the timings but also of the lift height of the gas exchange valves 2.

The pressure relief chambers 6 are connected to a common vent duct 11 in the hydraulic housing 4, which is hydraulically connected on the housing inner side, via restrictions 12, to the respective pressure relief chamber 6 and opens on the housing outer side into a hydraulic reservoir 13 in the interior of the cylinder head 1. The restrictions 12 are geodetically above the pressure relief chambers 6, that is to say in relation to the direction, symbolized by the arrow, of gravity g, and the hydraulic reservoir 13 is geodetically below the pressure relief chambers 6. The duct opening 14 of the vent duct 11 is geodetically not only below the level 15 of the hydraulic reservoir 13 but also below the boundary 16 of the pressure chamber 5 defined by the slave pistons 8 when said pistons are fully retracted into the hydraulic housing 4 with the gas exchange valves 2 closed. The hydraulic reservoir 13, which is unpressurized relative to the internal pressure of the cylinder head 1, is formed by a hollow 17 in the cylinder head 1 (see FIG. 1*b*), which is closed in the direction of gravity and in which hydraulic fluid collects during the operation of the internal combustion engine.

The vent duct 11 is formed on the housing outer side by a vent tube 18 screwed firmly and sealingly into the hydraulic housing 4. This tube has a circular first tube section 19, the tube inside diameter of which is between 8 mm and 9 mm. The first tube section 19 merges at a diameter step 20 into a circular second tube section 21 with a tube inside diameter of about 4 mm. The tube outside diameter of the second tube section 21 is correspondingly small and dimensioned in such a way that the second tube section 21 can be introduced into the hollow 17 without collisions when the hydraulic unit is installed in the cylinder head 1.

Figure 1B:
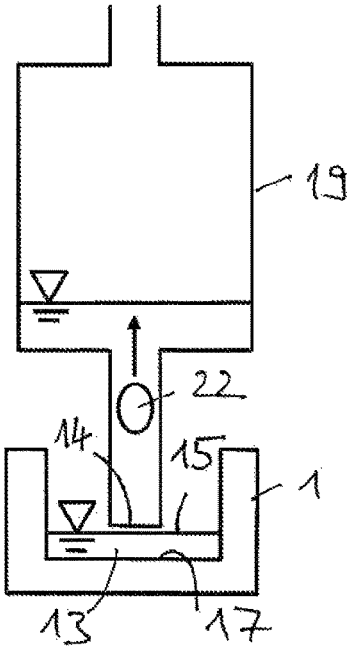
FIG. 1*b* shows the duct opening and the hydraulic reservoir of the first illustrative embodiment in an enlarged detail.

FIG. 1*a* shows the vented filling level of the hydraulic system shortly after the internal combustion engine is switched off. Here, the level 15 of the hydraulic reservoir 13 is the initially defined normal level. The detail in FIG. 1*b* shows the filling level of the hydraulic system at a significantly later time, at which the hydraulic fluid has cooled fully and the volume thereof has shrunk accordingly. The vacuum which forms with the decrease in volume in the hydraulic chambers has the effect that additional hydraulic fluid is sucked out of the hydraulic reservoir 13 into the pressure relief chambers 6. This induction of additional fluid without air bubbles ends when the level 15 of the hydraulic reservoir 13 falls geodetically below the duct opening 14. After this, pressure compensation between the pressure relief chambers 6 and the environment of the hydraulic housing 4 is accomplished by back suction of air bubbles 22. The tube inside diameter of the first tube section 19, which is significantly larger than the size of the air bubbles, enables the air bubbles 22 to migrate upward through the oil column situated therein, wherein the oil column closes again after the air bubbles 22 have passed through. This maintains a vacuum, which inhibits hydraulic leakage into the cylinder head 1 through the guide clearance between the slave pistons 8 and the hydraulic housing 4 and thus—in addition to the volume compensation from the hydraulic reservoir 13—delays the critical emptying of the pressure chamber 5.

Figure 2:
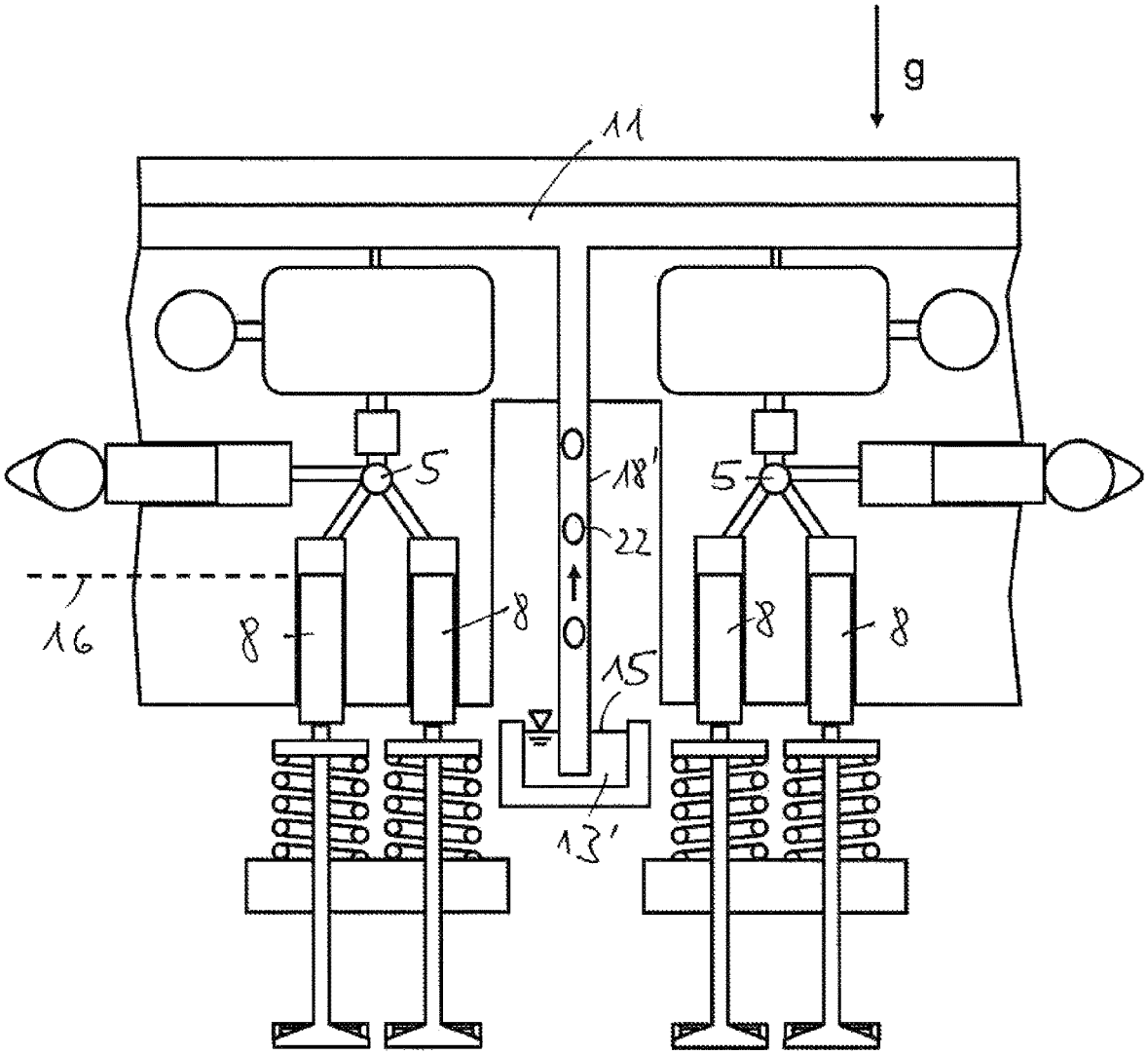
FIG. 2 shows the second illustrative embodiment with a relatively low-lying hydraulic reservoir.

In the second illustrative embodiment, which is illustrated in FIG. 2, the hydraulic reservoir 13' is geodetically significantly lower than in the first illustrative embodiment. The higher oil column between the boundary 16 and the level 15 of the hydraulic reservoir 13' causes an increased vacuum in the hydraulic system in favor of further reduced leakage of the pressure chambers 5 through the guide clearance around the slave pistons 8. In this embodiment, the vent duct 11 is formed by a vent tube 18' of uniform diameter, wherein the tube inside diameter is of such large dimensions in this case too that the air bubbles 22 rising therein can pass through the oil column standing in the vent tube 18'.

Figure 3:
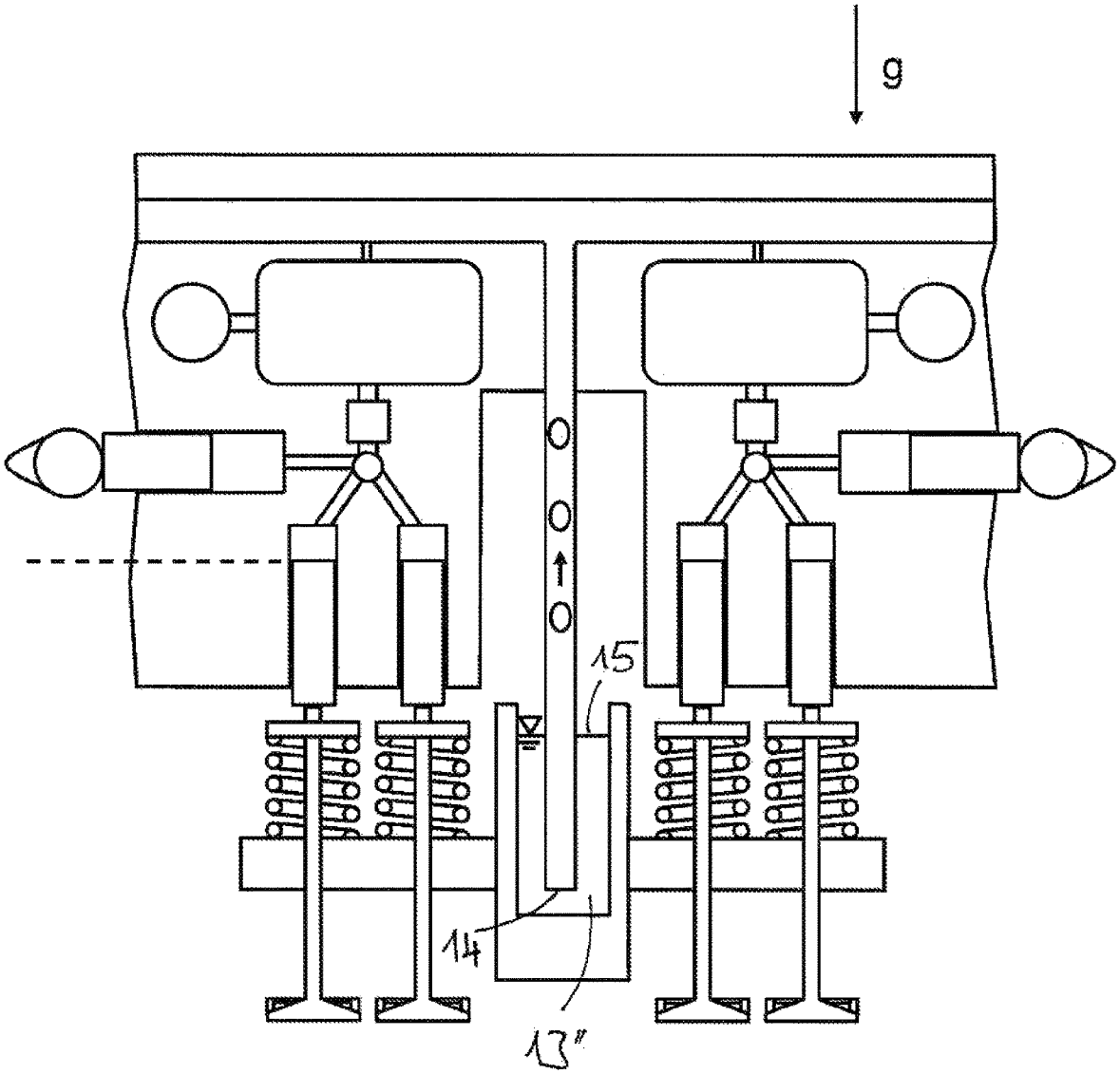
FIG. 3 shows the third illustrative embodiment with a duct opening which dips permanently into the hydraulic reservoir.

The third illustrative embodiment in FIG. 3 has a hydraulic reservoir 13", the volume of which is so large that the duct opening 14 is always geodetically below the level 15 of the hydraulic reservoir 13".

LIST OF REFERENCE CHARACTERS

1 cylinder head
2 gas exchange valve
3 cam
4 hydraulic housing
5 pressure chamber
6 pressure relief chamber
7 master piston
8 slave piston
9 hydraulic valve
10 piston-type pressure accumulator
11 vent duct
12 restriction
13 hydraulic reservoir
14 duct opening
15 level
16 boundary
17 hollow
18 vent tube
19 first tube section
20 diameter step
21 second tube section
22 air bubble

The invention claimed is:

1. An internal combustion engine having a hydraulically variable gas exchange valve train, the internal combustion engine comprises:

a hydraulic housing having:

a pressure chamber, a pressure relief chamber, and, a vent duct, and, the pressure chamber, the pressure relief chamber and the vent duct connected to one another hydraulically, a master piston, guided within the hydraulic housing, a first end of the master piston driven by a cam and a second end of the master piston defining the pressure chamber, a slave piston, guided within the hydraulic housing, a first end of the slave piston configured to drive a gas exchange valve and a second end of the slave piston defining the pressure chamber, and, a hydraulic valve, which, in a closed state, interrupts a hydraulic connection between the pressure relief chamber and the pressure chamber, and, the vent duct is connected hydraulically via a restriction to the pressure relief chamber, and opens below the pressure relief chamber in relation to a direction of gravity, and the vent duct opens into a hydraulic reservoir, and, after switching off the internal combustion engine, in a first state:

a vent duct opening is below a hydraulic fluid level of the hydraulic reservoir in relation to the direction of gravity, and, the vent duct is configured to flow hydraulic fluid from the hydraulic reservoir to the pressure relief chamber.

2. The internal combustion engine as claimed in claim 1, wherein when the gas exchange valve is closed, the vent duct opening is below a boundary of the pressure chamber defined by the slave piston in relation to the direction of gravity.

3. The internal combustion engine as claimed in claim 1, wherein the vent duct opening is always below the hydraulic fluid level of the hydraulic reservoir in relation to the direction of gravity.

4. The internal combustion engine as claimed in claim 1, wherein the vent duct has a circular first tube section having an inside diameter of at least 6 mm.

5. The internal combustion engine as claimed in claim 4, wherein the vent duct opening is formed by a circular second tube section adjoined to the circular first tube section, the circular second tube section having a tube outside diameter that is less than a tube outside diameter of the circular first tube section.

6. The internal combustion engine as claimed in claim 4, wherein the circular first tube section is part of a vent tube secured in the hydraulic housing.

7. The internal combustion engine as claimed in claim 1, wherein after switching off the internal combustion engine, in a second state, the vent duct opening is above the hydraulic fluid level of the hydraulic reservoir in relation to the direction of gravity.

8. The internal combustion engine as claimed in claim 1, wherein the hydraulic reservoir is formed by a hollow in a cylinder head of the internal combustion engine, the hollow being closed in the direction of gravity and configured to collect hydraulic fluid during operation of the internal combustion engine.

9. A hydraulically variable gas exchange valve train configured for an internal combustion engine, the valve train comprising:

a hydraulic housing having:

a pressure chamber;

a pressure relief chamber; and, a vent duct connected hydraulically to the pressure relief chamber; and, the pressure chamber, pressure relief chamber, and vent duct connected to one another hydraulically;

a master piston guided within the hydraulic housing, a first end of the master piston defining the pressure chamber and a second end configured to be driven a cam;

a slave piston guided within the hydraulic housing, a first side of the slave piston defining the pressure chamber and a second side of the slave piston configured to drive a gas exchange valve, and, a hydraulic valve configured to hydraulically connect or hydraulically disconnect the pressure relief chamber and the pressure chamber; and, the vent duct opens into a hydraulic reservoir below the pressure relief chamber in relation to a direction of gravity; and, after switching off the internal combustion engine, in a first state;

a vent duct opening is below a hydraulic fluid level of the hydraulic reservoir in relation to the direction of gravity; and the vent duct is configured to flow hydraulic fluid from the hydraulic reservoir to the pressure relief chamber.

10. The hydraulically variable gas exchange valve train of claim 9, wherein the hydraulic valve is configured to allow hydraulic fluid flow: i) from the pressure relief chamber to the pressure chamber; and, ii) from the pressure chamber to the pressure relief chamber.

11. The hydraulically variable gas exchange valve train of claim 9, wherein the vent duct includes a vent tube of uniform diameter, the vent tube having an opening that extends within the hydraulic reservoir.

12. The hydraulically variable gas exchange valve train of claim 9, wherein the vent duct includes a first section and a second section.

13. The hydraulically variable gas exchange valve train of claim 12, wherein the first section is a circular first section and the second section is a circular second section.

14. The hydraulically variable gas exchange valve train of claim 13, wherein a first inner diameter of the first section is larger than a second inner diameter of the second section.

15. The hydraulically variable gas exchange valve train of claim 14, wherein the first inner diameter is at least 8 mm.

16. The hydraulically variable gas exchange valve train of claim 9, wherein after switching off the internal combustion engine, in a second state, the vent duct opening is above the hydraulic fluid level of the hydraulic reservoir in relation to the direction of gravity.

17. The hydraulically variable gas exchange valve train of claim 9, wherein the vent duct is formed by a bleed tube secured in the hydraulic housing.

18. The hydraulically variable gas exchange valve train of claim 17, wherein the bleed tube includes a first section and a second section.

19. A hydraulically variable gas exchange valve train configured for an internal combustion engine, the valve train comprising:

a hydraulic housing having:

a pressure chamber;

a pressure relief chamber; and, a vent duct connected hydraulically to the pressure relief chamber; and, the pressure chamber, pressure relief chamber, and vent duct connected to one another hydraulically;

a master piston guided within the hydraulic housing, a first end of the master piston configured to be driven by a cam and a second end of the master piston defining the pressure chamber, a slave piston guided within the hydraulic housing, a first end of the slave piston configured to drive a gas exchange valve, and a second end of the slave piston defining the pressure chamber; and a hydraulic valve configured to hydraulically connect or hydraulically disconnect the pressure relief chamber and the pressure chamber;

a pressure accumulator configured to receive displaced fluid from the pressure relief chamber; and the vent duct configured to open into a hydraulic reservoir below the pressure relief chamber in relation to a direction of gravity.

20. The hydraulically variable gas exchange valve train of claim 19, wherein the hydraulic reservoir is configured to be arranged within a cylinder head of the internal combustion engine.

* * * * *